US006381434B1

(12) United States Patent
Yamamoto

(10) Patent No.: US 6,381,434 B1
(45) **Date of Patent: *Apr. 30, 2002**

(54) DEVELOPING APPARATUS WITH ELECTRIC FIELD FORCE DIRECTING A TONER CLOUD FOR COATING A DEVELOPER CARRYING MEMBER

(75) Inventor: Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/969,503

(22) Filed: Nov. 13, 1997

(30) Foreign Application Priority Data

Nov. 14, 1996 (JP) ..... 8-318834
Jan. 21, 1997 (JP) ..... 9-022071

(51) Int. Cl.[7] ..... G03G 15/08
(52) U.S. Cl. ..... 399/266; 399/281; 399/283
(58) Field of Search ..... 399/266, 290, 399/264, 273, 283, 272, 282; 118/631, 639, 640; 347/125, 151

(56) References Cited

U.S. PATENT DOCUMENTS

| | | | | |
|---|---|---|---|---|
| 2,221,776 A | | 11/1940 | Carlson | |
| 2,297,691 A | | 10/1942 | Carlson | |
| 2,874,063 A | | 2/1959 | Greig | |
| 3,909,258 A | | 9/1975 | Kotz | |
| 4,947,211 A | * | 8/1990 | Ono et al. | 399/283 X |
| 5,701,568 A | * | 12/1997 | Hiroshima et al. | 399/302 |

FOREIGN PATENT DOCUMENTS

| | | | |
|---|---|---|---|
| JP | 42-23910 | | 11/1942 |
| JP | 43-24748 | | 10/1943 |
| JP | 52-94140 | | 8/1977 |
| JP | 54-43038 | | 4/1979 |
| JP | 58-116559 | | 7/1983 |
| JP | 2-127669 | * | 5/1990 |
| JP | 5-197275 | * | 8/1993 |
| JP | 6-102746 | * | 4/1994 |
| JP | 6-161238 | * | 6/1994 |
| JP | 7-209921 | * | 8/1995 |

* cited by examiner

*Primary Examiner*—Quana M. Grainger
(74) *Attorney, Agent, or Firm*—Fitzpatrick, Cella, Harper & Scinto

(57) ABSTRACT

A developing apparatus includes a developer carrying member for developing an electrostatic image on an image carrying member with a toner. The apparatus also comprises a clouding means for forming a toner cloud, directed in a direction opposite to a moving direction of the developer carrying member, near the developer carrying member. The apparatus further includes a coating device for coating the developer carrying member with the toner in the toner cloud by force of an electric field.

16 Claims, 8 Drawing Sheets

DEVELOPING APPARATUS WITH ELECTRIC FIELD FORCE DIRECTING A TONER CLOUD FOR COATING A DEVELOPER CARRYING MEMBER

BACKGROUND OF THE INVENTION

1. Field of the Invention

The present invention relates to a developing apparatus used in image forming apparatus such as electrophotographic apparatus and electrostatic recording apparatus.

2. Related Background Art

There are a lot of conventionally known methods of electrophotography, for example as described in U.S. Pat. No. 2,297,691, Japanese Patent Publication No. 42-23910, and Japanese Patent Publication No. 43-24748. In ordinary methods, an electrostatic, latent image is formed on a photosensitive member by various means by the use of a photoelectric substance, the latent image is then developed by toner, a toner image thus obtained is transferred onto a transfer medium such as paper as occasion demands, and thereafter the image transferred is fixed by heating or solvent vapor or the like to obtain a copy.

There are also a variety of developing methods for visualizing the electric, latent image by use of toner. For example, many developing methods are known, including the magnetic brush developing method as described in U.S. Pat. No. 2,874,063, the powder cloud method and fur brush developing method as described in U.S. Pat. No. 2,221,776, and the liquid developing method.

Among these developing methods, the magnetic brush developing method using a two-component developer mainly containing toner and carrier is an excellent method capable of obtaining high-quality images relatively stably and is popularly used in practice. However, the magnetic brush developing method using the two-component developer has drawbacks of deterioration of carrier and variation in mixture ratios of toner and carrier, because it uses the two-component developer. In addition, it requires an agitating member, a toner concentration sensor, and the like to be set in the developing unit in order to overcome the drawbacks. The problem was, therefore, that the developing unit itself became large.

For avoiding this problem, a variety of developing methods using a one-component developer containing only toner have been proposed. For example, U.S. Pat. No. 3,909,258 proposed a method for developing the latent image by use of magnetic toner having the electrically conductive property. This is a method for developing the electrostatic, latent image by supporting the magnetic toner on a cylindrical, conductive sleeve (developing sleeve) having a magnet inside and making the toner contact the latent image. On this occasion, toner particles form conductive paths between the surface of photosensitive member and the surface of developing sleeve in the developing section, the charge is guided via these conductive paths from the developing sleeve to the toner particles, and the toner particles adhere to image portions by Coulomb force with respect to the image portions of the electrostatic, latent image, thereby developing the image. This developing method using the conductive, magnetic toner is an excellent method avoiding the problem in the conventional two-component developing method, but, on the other hand, it has a drawback that, because the toner is electrically conductive, it is difficult to electrostatically transfer the developed toner image from the photosensitive member to a final support member such as plain paper.

For solving this problem, a developing method using high-resistance toner to enable the electrostatic transfer was proposed; for example, Japanese Patent Application Laid-open No. 52-94140 describes a developing method utilizing dielectric polarization of toner particles. This method, however, has such drawbacks that the developing speed is essentially slow, the density of developed image is not sufficient, and so on, and it was not practically applicable. Other known methods using the magnetic toner of high resistance are those for frictionally electrifying the toner particles by friction between toner particles, friction between toner particles and developing sleeve, etc. and making them contact the photosensitive member, thereby developing the electrostatic, latent image. It is, however, pointed out that these methods have such drawbacks that the amount of contact is small between the toner particles and a frictional member, so as to result in insufficient frictional electricity (triboelectricity) and that when the Coulomb force is strong between the charged toner particles and the developing sleeve, the toner particles are likely to aggregate on the developing sleeve, and therefore, they have many difficulties in practical use.

Against it, Japanese Patent Application Laid-open No. 54-43038 proposes a novel developing method eliminating the above drawbacks. This is a method for making an elastic blade of rubber or metal contact the developing sleeve, thereby frictionally electrifying the toner on the developing sleeve and forming a thin layer of the toner thereon, and then bringing it to the very vicinity of the electrostatic, latent image under action of magnetic field to keep the toner layer opposed thereto without contact, thereby developing the latent image. This method increases the chances of contact between the magnetic toner and the developing sleeve by making the very thin coating of magnetic toner, thereby enabling to give the toner an amount of triboelectric charge necessary for development. However, since the magnetic toner includes a magnetic material such as magnetite, this method has problems that it is difficult to apply it to color toner and that it is very difficult to decrease power consumption, because the fixing temperature must be set rather high.

On the other hand, a non-magnetic one-component developing method not using the magnetic toner is proposed and used in practice, as described in Japanese Patent Application Laid-open No. 58-116559. Since this method can be applied to formation of color image and can realize a inexpensive and compact developing apparatus, it is frequently used in developing units of printer or the like.

FIG. 8 shows a developing apparatus using the conventional, non-magnetic one-component developing method. This developing apparatus has a developing sleeve 11 in an opening portion of developing container 13 for accommodating the non-magnetic toner of one-component developer. This developing sleeve 11 is opposed with a predetermined clearance to the photosensitive drum (not illustrated) and is driven to rotate in the direction of the arrow. A toner supply roller 14 is set in contact with the developing sleeve 11 inside the container 13. The supply roller 14 is constructed in such manner that an elastic member **14*b* of urethane foam or the like covers the outside periphery of core 14*a* of SUS or the like. The supply roller 14 frictionally rotates in the direction of the arrow relative to the developing sleeve 11, so as to supply the non-magnetic toner in the container 13 to the surface of the developing sleeve 11 to form a coating of toner thereon, and it also scrapes off the residual toner not having contributed to development from the surface of developing sleeve 11. A regulating blade 12 is in contact with and on an almost top part of developing sleeve 11. This regulating blade 12 is constructed in such structure that an elastic member 12***b* of urethane rubber or the like is bonded to a surface of elastic support member 12*a* of phosphor bronze or the like on the opposed side to the developing sleeve 11 and the regulating blade 12 functions to form a thin layer of toner by regulating the non-magnetic toner supplied to the surface of developing sleeve 11 and to give the charge to the toner.

By employing the above construction, the non-magnetic one-component developing apparatus well forms the thin layer of non-magnetic toner on the developing sleeve 11, so that it can well develop the electrostatic, latent image on the photosensitive drum.

However, when the coating of toner was formed on the developing sleeve 11 by frictional rotation of the toner supply roller 14 in contact with the developing sleeve 11, non-charged toner was often supplied onto the developing sleeve 11, depending upon the placement location and rotation direction of the toner supply roller 14, and upon the placement location of the regulating blade 12.

When an excessive amount of coating of non-charged toner was supplied onto the developing sleeve 11, the regulating section by the regulating blade 12 sometimes failed to give the sufficient charge to the non-charged toner, so that deviation of in-layer charge amount distribution could appear in the toner layer formed on the developing sleeve by regulation, which sometimes caused negative effects such as fog and nonuniformity on the developed image. In addition, the method had a drawback that the load on the toner was very heavy in the contact portion between the toner supply roller 14 and the developing sleeve 11, so that the toner was thus likely to be deteriorated thereby.

According to studies by the inventors, the above toner supplying means sometimes failed to perfectly remove the toner remaining on the developing sleeve 11, so as to leave some of it on the developing sleeve. As a result, the residual toner passed many times between the regulating blade 12 and the developing sleeve 11 and between the toner supply roller 14 and the developing sleeve 11. It was thus found that frictional heat upon passage accumulated in the residual toner and quickly deteriorated the toner on the developing sleeve 11. This deteriorated toner could fuse to the nip portion of regulating blade 12, which would be a cause to induce failure in toner coating, e.g., dripping thereof.

Since the residual toner and new toner was mixed on the developing sleeve 11, development hysteresis such as ghosting often occurred. Further, continuation of use gradually increased the charge amount of residual toner, which impeded supply of new toner and degraded the development property because of decrease in coating amount of toner in some cases. In addition, after the toner supply roller 14 was rubbed on the developing sleeve 11 for a long period, the roller 14 itself was worn or damaged, thereby making the supply and stripping of toner insufficient.

Therefore, the one-component developing method using the non-magnetic toner as described above is mainly used in cartridge type developing apparatuses which are poor in endurance stability of toner and developing apparatus and which are replaced entirely when the toner is used up, and it is not often employed in the developing apparatuses of the type to be replenished with developer, such as copiers.

SUMMARY OF THE INVENTION

An object of the present invention is to provide a developing apparatus capable of supplying only sufficiently charged toner to a developer carrying member.

Another object of the present invention is to provide a developing apparatus capable of coating a developer carrying member with toner without applying pressure to the toner.

Still another object of the present invention is to provide a developing apparatus capable of preventing deterioration of toner.

Still another object of the present invention is to provide a developing apparatus comprising:

a developer carrying member for developing an electrostatic image on an image carrying member with toner;

clouding means for forming a toner cloud near said developer carrying member; and coating means for coating said developer carrying member with the toner in the toner cloud by force of electric field.

Further objects of the present invention will become apparent by the descriptive matter which follows.

DETAILED DESCRIPTION OF THE PREFERRED EMBODIMENTS (Embodiment 1)

Figure 1:
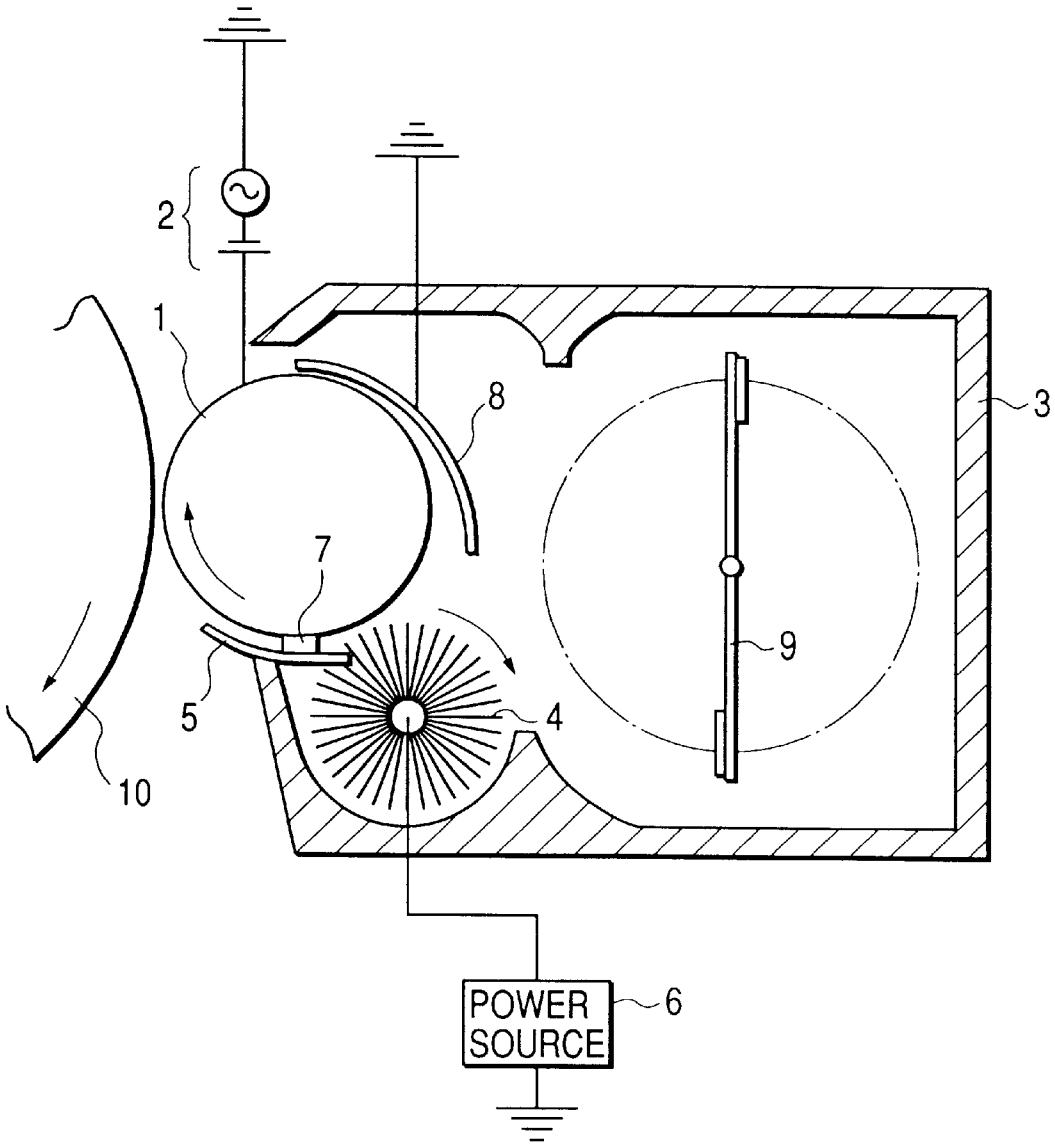
FIG. 1 is a cross-sectional view to show an embodiment of the developing apparatus of the present invention.

FIG. 1 is a cross-sectional view to show an embodiment of the developing apparatus of the present invention.

As shown in FIG. 1, the developing apparatus of the present embodiment has the developing sleeve 1 being a developer carrying member, in an opening portion of developing container 3 accommodating the non-magnetic toner of one-component developer. This developing sleeve 1 is opposed with a predetermined clearance to the photosensitive drum 10 being an image carrying member, and is driven to rotate in the direction of the arrow. Power source 2 is connected to the developing sleeve 1 to apply a desired developing bias in which an AC voltage is superimposed on a DC voltage, to the photosensitive drum 10.

A toner supply brush 4 for supplying the non-magnetic toner to the developing sleeve 1 is set inside the container 3 and this supply brush 4 is placed obliquely below the developing sleeve 1 on the opposite side to the photosensitive drum 10 and in a non-contact state with a clearance of about 100 $\mu$m to 1 mm to the developing sleeve 1. The supply brush 4 is rotated in the opposite direction to the direction of rotation of the developing sleeve 1 in the nearest section thereto.

The present embodiment adopts a fur brush as the toner supply brush 4. This fur brush was made by flocking a core of SUS or the like with conductive fibers that little showed variation in electrical characteristics due to environmental variation. The conductive fibers were polyamide (nylon) based or rayon based fibers, which had the resistivity of $10^3$ to $10^8$ Ωcm, the flocking density of 20,000 to 200,000, the size of 1 to 10 denier/filament, and the pile length of 1 to 10 mm. Power source 6 for applying a DC voltage to the supply brush 4 is connected thereto.

Figure 2:
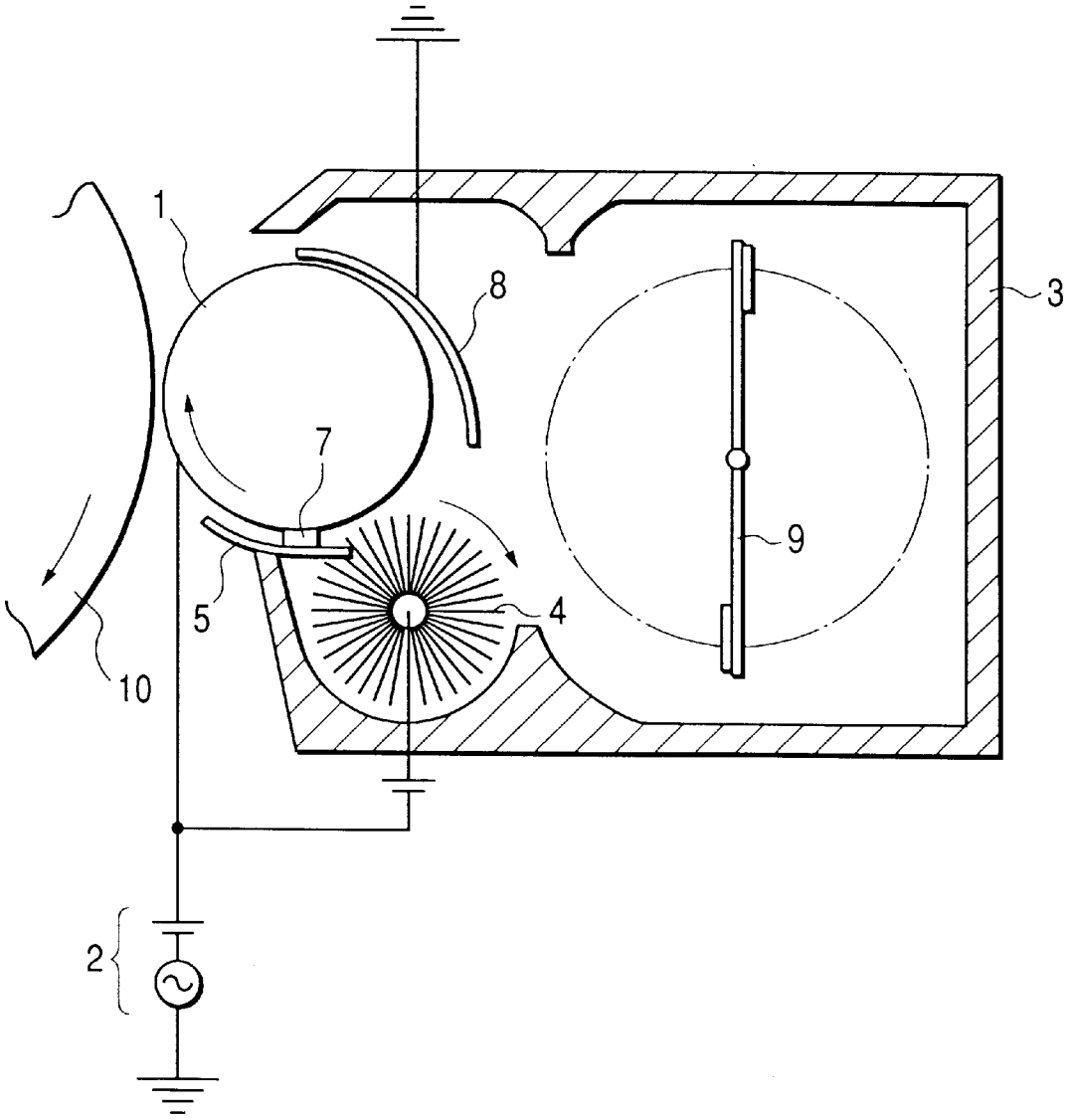
FIG. 2 is a cross-sectional view to show another arrangement of power supply to a toner supply brush in the developing apparatus of FIG. 1.

The electrical wiring as shown in FIG. 2 may also be employed for applying the voltage to the supply brush 4 so that only desired DC part with respect to the developing bias is placed between the developing sleeve 1 and the supply brush 4.

Figure 3:
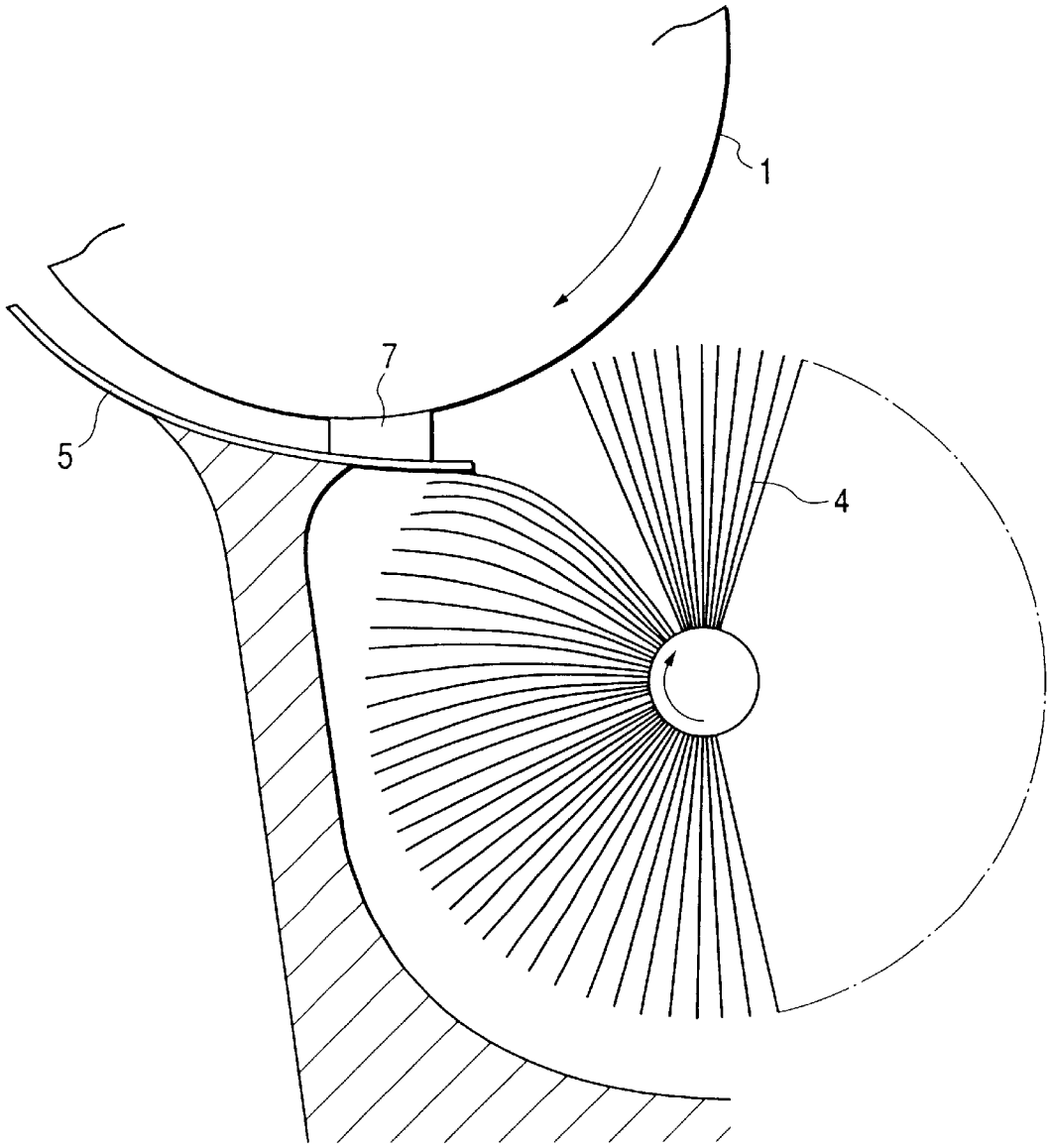
FIG. 3 is a detailed figure to show a toner supply section by the toner supply brush installed in the developing apparatus of FIG. 1.

A contact member 5 for clouding the toner by contact with the supply brush 4 in the toner supply section is installed below the developing sleeve 1 as shown in FIG. 3, and this contact member 5 is placed upstream of the developer supply section with respect to the direction of rotation of brush 4 so that the toner flipped from the brush 4 flies toward the developing sleeve 1.

In the present embodiment the above contact member is made of SUS sheet approximately 50 μm to 1 mm thick, but the contact member 5 may also be made of any material without having to be limited to the SUS sheet, if the desired cloud flow is created. The contact member 5 may be made of a sheet of another metal such as phosphor bronze or a resin sheet of PET or the like. Further, a resin layer of polyamide (nylon) or the like may be formed on a surface of the contact member 5 in contact with the brush 4, for the purpose of giving the charge to the toner.

A toner regulating member 7 is supported on the upper surface of contact member 5 and, in the present embodiment, the toner regulating member 7 is made of an elastic body of rubber material such as urethane or silicone having JIS hardness 50° to 70°. The toner regulating member 7 is in contact with the developing sleeve 1 under the pressure of 5 to 50 g/cm. The toner regulating member 7 regulates the thickness of non-magnetic toner coating formed on the developing sleeve 1 by the supply brush 4, thereby forming the toner layer in a desired thickness.

A stripping electrode member 8 serving as toner collecting means is provided in a section from top to side of the developing sleeve 1 in the developing container 3, and this electrode member 8 is placed in a non-contact state to the developing sleeve 1 along the periphery thereof, preferably so as to increase the clearance to the developing sleeve 1 at the lower end. The electrode member 8 is earthed and functions to electrically strip the toner not having contributed to the development on the developing sleeve 1 from the surface thereof to collect it into the container 3 and again return it to the developing step. An agitating member 9 for feeding the toner to the supply brush 4 is provided far inside the container 3.

In the present embodiment the non-magnetic toner is the one obtained by mixing a coloring agent in a thermoplastic resin to disperse it therein, crushing the resin, and classifying it (i.e., crushed toner), the weight mean particle diameter of which is 5 μm or more. The thermoplastic resin is a resin selected from polyethylene based resins, polyester based resins, and other resins having the negatively charged property. The developing method is the inversion development method for depositing the toner on image-exposed portions; the surface of photosensitive drum 10 is negatively charged by charging means not illustrated, an electrostatic, latent image is formed by image exposure by exposure means, and the latent image is inversely developed with the non-magnetic toner of the negative polarity while the developing bias of negative DC voltage and AC voltage superimposed is applied to the developing sleeve 1.

The photosensitive drum 10 is an OPC photosensitive member and the developing sleeve 1 is a coat developing sleeve obtained by coating of a resin in which PMMA and dimethylamino ethyl methacrylate are mixed in 9:1.

The non-magnetic toner in the developing container 3 is fed to the supply brush 4 by the agitating member 9 to come to contact the conductive fibers of supply brush 4 and to be negatively charged thereby. On that occasion, the toner is carried between the fibers of supply brush 4 and on the surface of fibers by adhesive force such as the mirror force, and is conveyed toward the contact member 5 with rotation of the supply brush 4. The toner having been conveyed to the contact portion with the contact member 5 comes to contact the contact member 5, thereby being negatively charged more stably.

Figure 4:
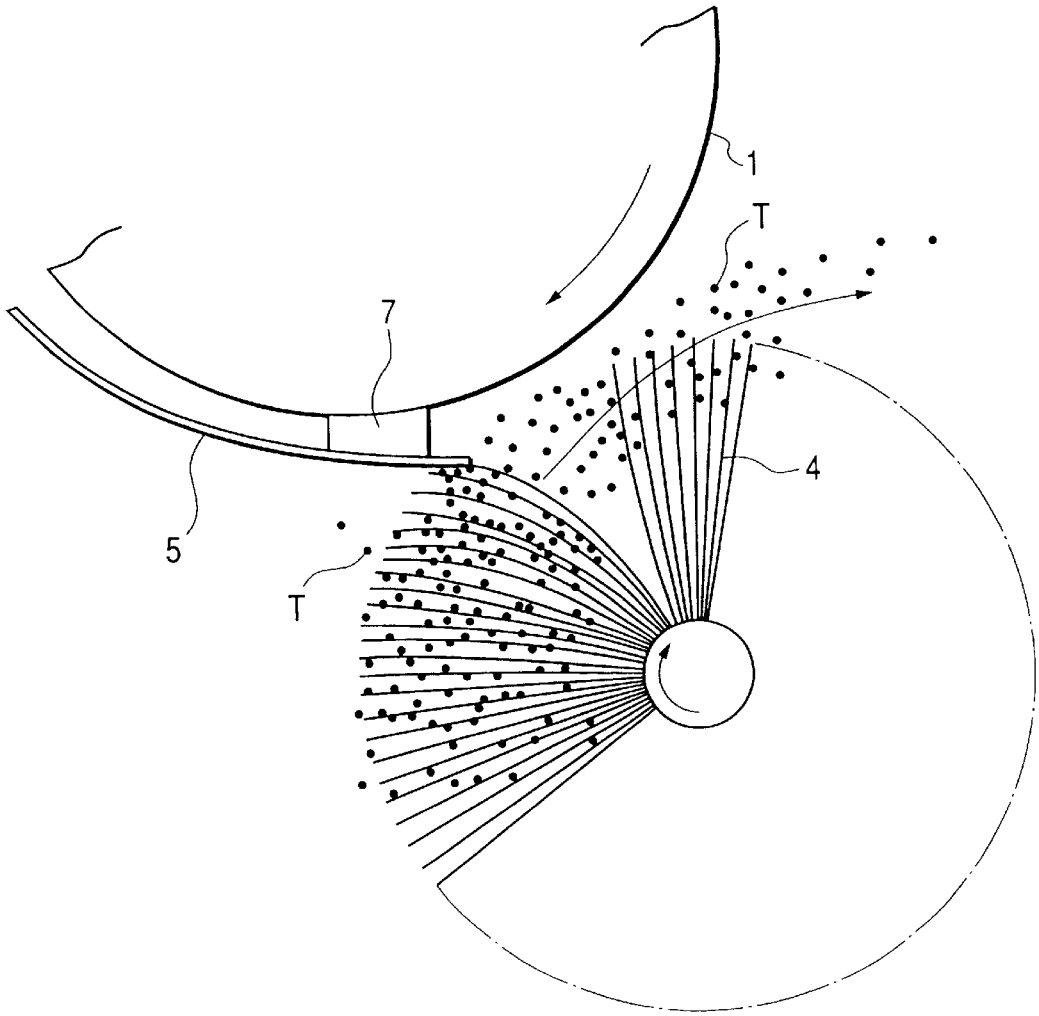
FIG. 4 is an explanatory drawing to show a state in which the toner is flipped in a cloud form from the toner supply brush.

After passing the contact portion with the contact member 5 as being carried by the brush fibers of supply brush 4, the toner is flipped in the direction of the arrow along the rotating direction of supply brush 4 by the brush fibers, as shown in FIG. 4, so that the toner T flies in the cloud form. As for the toner supply brush 4, this flipping discharges the toner held between the brush fibers therefrom, whereby toner clogging is prevented between fibers.

Figure 5:
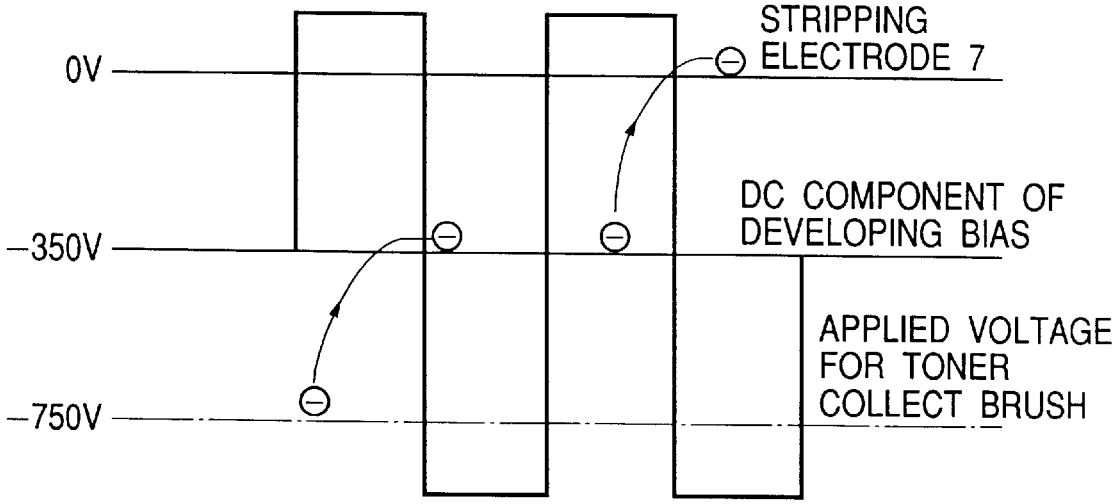
FIG. 5 is an explanatory drawing to show the potential relation among the toner supply brush to which a DC voltage is applied, the developing sleeve to which a developing bias is applied, and the ground.

Further, the power source 2 applies the developing bias to the developing sleeve 1 and the power source 6 applies the DC bias to the supply brush 4. A voltage difference between the DC voltage component of this developing bias and the DC voltage of supply brush 4 forms an electric field for attracting the negatively charged toner from the supply brush 4 toward the developing sleeve 1, between the supply brush 4 and the developing sleeve 1. For example, as shown in FIG. 5, when the DC voltage component of the developing bias is set to −350 V, the DC voltage applied to the toner supply brush 4 is set to approximately −750 V. This causes only the sufficiently negatively charged toner among the toner T in the cloud form and the toner T in the toner supply brush 4 to be attracted to the developing sleeve 1, so that the attracted toner is supplied to the surface of developing sleeve 1.

The toner supplied to the developing sleeve 1 adheres to the surface of developing sleeve 1 by its mirror force to be carried thereon, and it is conveyed up to the toner regulating member 7. The toner is then subjected to thin film formation and further provision of triboelectric charge by the regulating member 7, thereby forming a toner layer of thin film having a uniform charge amount distribution.

As described above, the present invention can greatly reduce mechanical stress on the toner, because the charged toner is once clouded and the toner is supplied without contact to the developing sleeve 1 by the electric field. Since only the sufficiently charged toner can be supplied to the developing sleeve 1, the toner layer on the developing sleeve 1 obtained by regulation with the regulating member 7 can be very sharp with little deviation of charge amount distribution. Accordingly, a stable image of high quality can be obtained by carrying out the excellent development.

On the other hand, the residual toner not having contributed to the development in the development section is returned to the developing container 3 as being carried on the developing sleeve 1 and is conveyed to the region opposed to the earthed electrode member 8. Then the residual toner is stripped off from the surface of developing sleeve 1 toward the electrode member 8 by the voltage difference between the DC voltage component of the developing bias applied to the developing sleeve 1 and the earth of the electrode member 8, and the toner further drops to the vicinity of supply brush 4 as vibrating between the developing sleeve 1 and the electrode member 8 by the AC voltage component of the developing bias. Then the toner is charged by the supply brush 4 to be carried thereon and is supplied to the developing sleeve 1 to be again used in the development step. Accordingly, the newly charged toner is always supplied onto the developing sleeve 1 and the residual toner is prevented from passing many times between the regulating member 7 and the developing sleeve 1. Therefore, the frictional heat is prevented from accumulating in the toner, so that the toner is prevented from being deteriorated quickly. As a result, the development hysteresis such as ghosting is prevented from occurring in the developed image.

(Embodiment 2)

Figure 6:
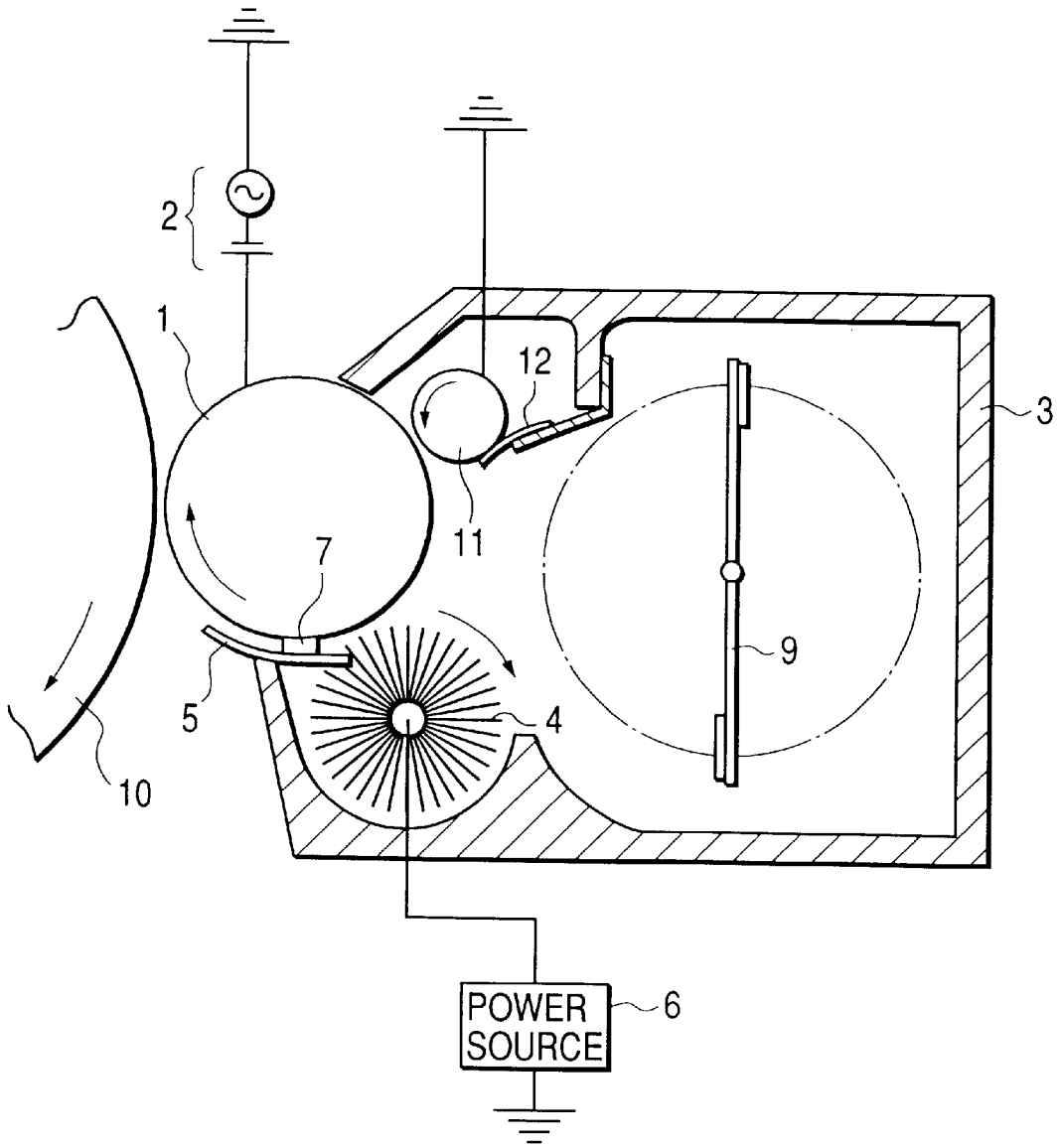
FIG. 6 is a cross-sectional view to show another embodiment of the present invention.

FIG. 6 is a cross-sectional view to show another embodiment of the present invention.

In the present invention, the toner collecting means is not limited to the plate shape shown in Embodiment 1, but it may be, for example, of a cylindrical shape. It was found that, because the toner collecting means of the cylindrical shape made it easier to concentrate the electric field in the opposed portion to the developing sleeve 1 because of the shape, the stripping and collection of toner was able to be made stabler.

According to the present embodiment, a toner collecting roller 11 is a cylindrical metal member the surface of which is a mirror surface, is opposed with a clearance of about 100 $\mu$m to 1 mm to the developing sleeve 1, and it is driven to rotate in the opposite direction to the developing sleeve 1 (but in the same direction in the nearest portion). The collecting roller 11 is earthed.

In the same manner as in Embodiment 1, the residual toner, returned into the developing container 3 as being carried on the developing sleeve 1 without contributing to the development, is stripped off by the electric field (which is stronger than with the electrode member 8 of Embodiment 1) formed in the nearest portion between the collecting roller 11 and the developing sleeve 1, and electrostatically adheres to the surface of collecting roller 11 to be collected. The collected toner is conveyed to the further inside of the developing container 3 with rotation of the collecting roller 11, it is then scraped off by scraper 12 in contact therewith, and the toner drops to the vicinity of toner supply brush 4 to be again used in the development step.

Since the rotatable collecting roller 11 of the cylindrical shape can always oppose its fresh electrode surface to the surface of developing sleeve 1 as described above, the stable electric field is always formed between the developing sleeve 1 and the collecting roller 11, which drastically increases the stripping and collection efficiency of toner. Since the toner deposited on the collecting roller 11 is stripped off by the scraper 12 every rotation of collecting roller 11, heat is prevented from accumulating in the toner, and the toner is thus almost free of the influence to induce deterioration.

The present invention was described above with Embodiments 1 and 2, but it is noted that the non-magnetic toner used in the present invention is not limited to the crushed toner used in Embodiments 1 and 2. For example, the non-magnetic toner applicable in the present invention may be low-melting-point toner recently used for the purpose of energy saving, which is polymerized toner polymerized by suspension polymerization, containing 5 to 30% by weight of a low-softening-point material, and formed in such a spherical shape that the shape factor SF-1 is between 100 and 140 and the shape factor SF-2 is between 100 and 120. More effective results are achieved by use of such non-magnetic toner.

Since the hardness of the polymerized toner was much lower than that of the crushed toner, the polymerized toner experienced extremely fast degradation of toner when used in the conventional, non-magnetic one-component developing apparatuses. Use of the polymerized toner in the conventional developing apparatuses thus posed the problems of marked occurrence of fusion to blade, coat unevenness of toner, dripping of toner, and so on. As described in Embodiments 1 and 2, according to the present invention, the coating of non-magnetic toner is formed on the developing sleeve in the non-contact manner, so that even if the non-magnetic toner is the polymerized toner the good toner layer can be formed stably for a long period with greatly decreasing deterioration of toner, which enables to achieve high-quality images.

Figure 7:
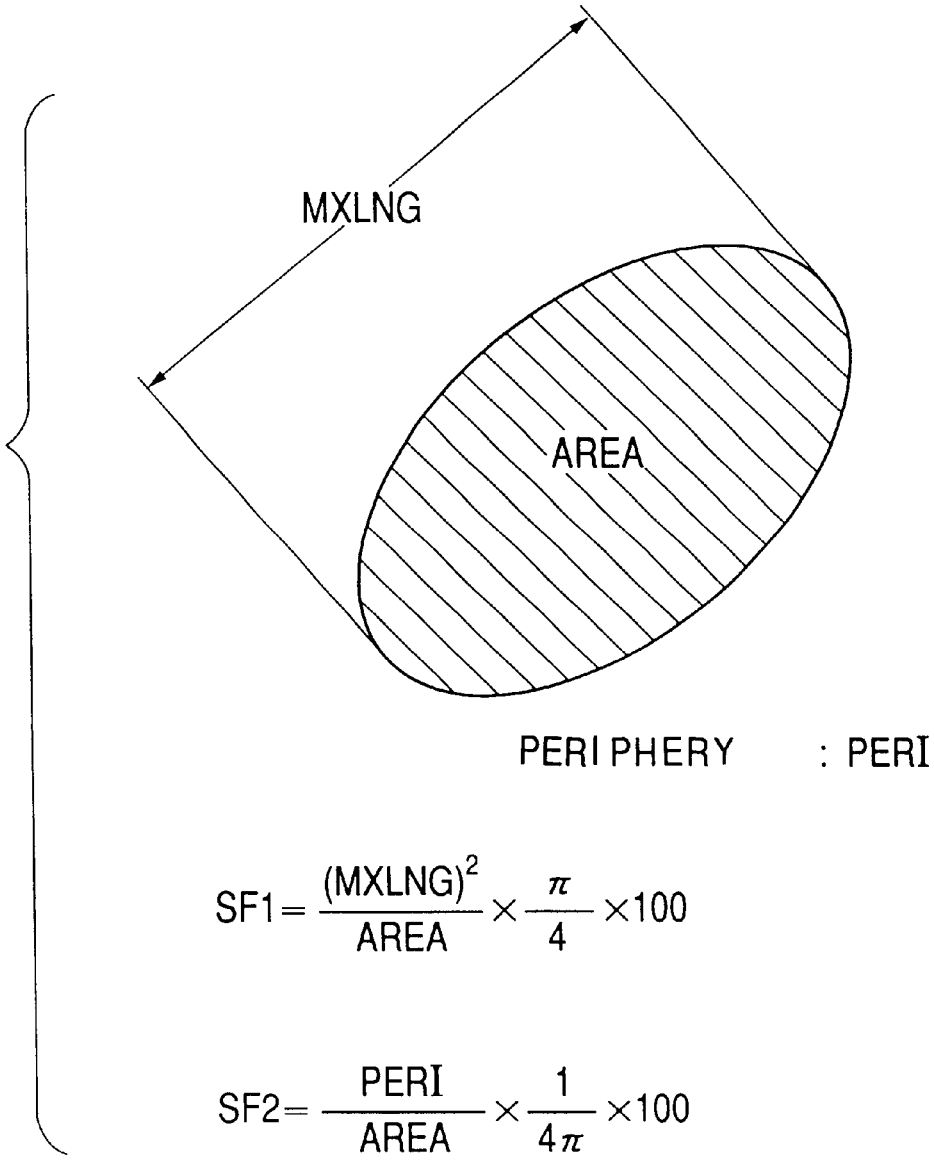
FIG. 7 is a drawing for explaining shape factors of spherical toner that can be suitably used in the developing apparatus of the present invention.
Figure 8:
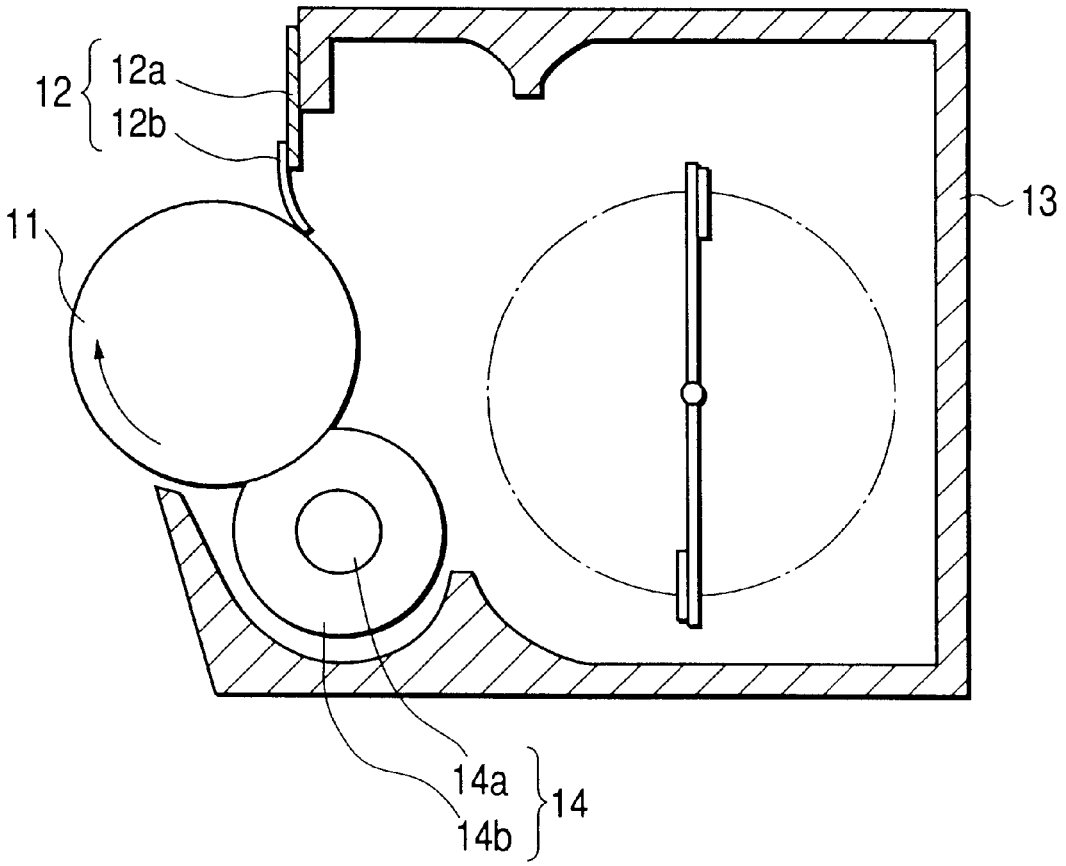
FIG. 8 PRIOR ART
FIG. 8 is a cross-sectional view to show the conventional developing apparatus.

In the above description, the shape factor SF-1 is a numerical value indicating the degree of round of spherical material, as shown in FIG. 7, which is expressed by a value obtained by dividing the square of maximum MXLNG of an elliptic figure formed when the spherical material is projected onto a two-dimensional plane, by the area AREA of the figure and multiplying the division result by $100\pi/4$. As the shape factor SF-1 becomes larger than 140, the shape gradually changes from the spherical shape to an indeterminate shape. On the other hand, the shape factor SF-2 indicates the degree of unevenness of shape, which is expressed by a value obtained by dividing the periphery PERI of the elliptic figure by the area AREA of the figure and multiplying the division result by $100\times4\ \pi$. If the shape factor SF-2 is larger than 120 the unevenness of toner surface will be prominent.

$$SF\text{-}1=\{(MXLNG)^2/AREA\}\times\pi/4\times100$$

$$SF\text{-}2=(PERI/AREA)\times\pi/4\times100$$

In the present invention, SF-1 and SF-2 of toner were calculated according to the above equations by sampling a hundred toner particle images at random by use of FE-SEM (S-800) available from Hitachi, Ltd., supplying image information obtained to an image analyzer (Luzex 3) available from Nicolet Japan Corporation, and analyzing it thereby.

For facilitating fabrication of spherical toner and decreasing the melting point, the spherical toner was formed in the core/shell structure, wherein the shell part was made by polymerization and the core of the low-softening-point material, for example, paraffin based wax, was enclosed therein. It is needless to mention that an advantage of the core/shell structure is that the toner can be provided with blocking resistance without degrading an excellent fixing property of toner, and a further advantage thereof is that polymerization of only the shell part makes it easier to remove the residual monomer in a subsequent process after the polymerization step, when compared with the polymerized toner of bulk without the core.

The embodiments of the present invention were described above, but it is noted that the present invention is by no means intended to be limited to these embodiments and can involve all modifications within the technical concept thereof.

What is claimed is:

1. A developing apparatus comprising:

a developer carrying member for developing an electrostatic image on an image carrying member with a toner;

means for moving said developer carrying member in a moving direction;

clouding means for forming a toner cloud directed in a direction opposite to a moving direction of said developer carrying member, near said developer carrying member; and coating means for coating said developer carrying member with the toner in the toner cloud by force of an electric field.

2. A developing apparatus according to claim 1, wherein said clouding means has a rotary brush, provided in a non-contact state to said developer carrying member, for supplying the toner.

3. A developing apparatus according to claim 2, comprising a tapped member arranged to be tapped by the rotary brush, thereby supplying the toner from said brush.

4. A developing apparatus according to claim 2, wherein the brush has a conductive fiber, and said coating means forms an electric field for generating force for directing the toner toward the developer carrying member between the brush and said developer carrying member.

5. A developing apparatus according to claim 1, wherein the toner is non-magnetic.

6. A developing apparatus according to claim 5, wherein the toner has shape factors SF1 between 100 and 140 and SF2 between 100 and 120.

7. A developing apparatus according to claim 5, wherein the toner is polymerized toner.

8. A developing apparatus according to claim 5, wherein the toner contains 5 to 30 parts by weight of a low-softening-point material.

9. A developer apparatus comprising:

a developer carrying member for developing an electrostatic image on an image carrying member with a toner;

clouding means, for forming a toner cloud passing in the vicinity of said developer carrying member in a direction away from said developing carrying member; and coating means for coating said developer carrying member with the toner in the toner cloud by force of an electric field.

10. A developing apparatus according to claim 9, wherein said clouding means comprises a rotary brush provided in a noncontact state to said developer carrying member, for supplying the toner.

11. A developing apparatus according to claim 10, comprising a tapped member arranged to be tapped by said rotary brush, thereby supplying the toner from said brush.

12. A developing apparatus according to claim 10, wherein said rotary brush has a conductive fiber, and said coating means forms an electric field for generating force for directing the toner toward said developer carrying member between said rotary brush and said developer carrying member.

13. A developing apparatus according to claim 9, wherein the toner is non-magnetic.

14. A developing apparatus according to claim 13, wherein the toner has shape factors SF1 between 100 and 140 and SF2 between 100 and 120.

15. A developing apparatus according to claim 13, wherein the toner is polymerized toner.

16. A developing apparatus according to claim 13, wherein the toner contains 5 to 30 parts by weight of a low-softening-point material.

* * * * *

UNITED STATES PATENT AND TRADEMARK OFFICE

CERTIFICATE OF CORRECTION

PATENT NO. : 6,381,434 B1
APPLICATION NO. : 08/969503
DATED : April 30, 2002
INVENTOR(S) : Takeshi Yamamoto It is certified that error appears in the above-identified patent and that said Letters Patent is hereby corrected as shown below:

ON THE TITLE PAGE:

ITEM (56) IN FOREIGN PATENT DOCUMENTS:

"42-23910 11/1942" should read --42-23910 11/1967--; and
"43-24748 10/1943" should read --43-24784 10/1968--.

COLUMN 2:

Line 44, "a" should read --an--.

COLUMN 5:

Line 1, "little showed" should read --showed little--.

COLUMN 8:

Line 20, "round" should read --roundness--; and
Line 48, "paraffin based" should read --paraffin-based--.

Signed and Sealed this

Twenty-fifth Day of December, 2007

JON W. DUDAS
*Director of the United States Patent and Trademark Office*